US005522730A

United States Patent [19]

Soes et al.

[11] Patent Number: 5,522,730

[45] Date of Patent: Jun. 4, 1996

[54] ELECTRICAL PIN FIELD

[75] Inventors: Lucas Soes, Rosmalen; Johannes M. Broeksteeg, Oss, both of Netherlands

[73] Assignee: The Whitaker Corporation, Wilmington, Del.

[21] Appl. No.: 345,062

[22] Filed: Nov. 25, 1994

Related U.S. Application Data

[63] Continuation-in-part of Ser. No. 86,485, Jul. 1, 1993, abandoned.

[30] Foreign Application Priority Data

Dec. 13, 1993 [NL] Netherlands ..... 9325421

[51] Int. Cl.[6] ..... H01R 23/72

[52] U.S. Cl. ..... 439/78; 439/572

[58] Field of Search ..... 439/78, 93, 587, 439/589, 571, 572, 892, 893

[56] References Cited

U.S. PATENT DOCUMENTS

| | | | |
|---|---|---|---|
| 4,674,812 | 6/1987 | Thom et al. | 439/78 |
| 4,753,601 | 6/1988 | Cobaugh | 439/62 |
| 4,836,791 | 6/1989 | Grabbe et al. | 439/79 |
| 5,015,192 | 2/1991 | Welsh et al. | 439/78 |

FOREIGN PATENT DOCUMENTS

| | | |
|---|---|---|
| 0138368 | 4/1985 | European Pat. Off. . |
| 0195955 | 10/1986 | European Pat. Off. . |
| 0273589 | 7/1988 | European Pat. Off. . |
| 0428259A2 | 5/1991 | European Pat. Off. . |
| 0578487A1 | 1/1994 | European Pat. Off. . |
| 8427749 | 3/1986 | Germany . |

*Primary Examiner*—Neil Abrams
*Attorney, Agent, or Firm*—Eric Groen

[57] ABSTRACT

An electrical pin field is shown having a printed circuit board having a plurality of pins inserted therethrough, having contact sections positioned on opposite sides of the board. An insulating housing is positioned on one side of the printed circuit board, whereas a housing is positioned on the opposite side, being held in place by way of a locking plate. The locking plate includes two opposing locking arms, which when the locking plate, and housing are fully positioned on the printed circuit board grip the pin terminal portions adjacent to the board, thereby retaining the housing to the board.

25 Claims, 8 Drawing Sheets

ELECTRICAL PIN FIELD

CROSS REFERENCE TO RELATED APPLICATION

This application is a continuation-in-part application of U.S. patent application Ser. No. 08/086,485 filed Jul. 1, 1993, now abandoned.

BACKGROUND OF THE INVENTION

1. Field of the Invention

The subject invention relates to a pin field inserted in a printed circuit board, with back-to-back headers positioned on opposite sides of the printed circuit board.

2. Description of the Prior Art

It is well known to form a pin field in printed circuit boards. These pins would be electrically connected to circuit traces in a printed circuit board, by way of press fit, such as for example by way of compliant pin portions within the printed circuit board through hole. Extending in opposite directions from the compliant pins, are pin portions, profiled for mating with complementary terminals in a complementary connector. Housings are positioned over the pins on opposite sides of the printed circuit boards to form a completed connector assembly. A difficulty which has arisen, is the method of retaining the housings to the pin field.

The printed circuit boards of the subject pin fields may have through holes having a diameter as small as 0.55 mm in diameter. Thus, the pin has on one side of the compliant pin portion, an enlarged barb, which is larger than the nominal width of the pin, which is profiled for interference fit within the corresponding housing. However, as the pin must be inserted through the printed circuit board through hole, the side of the pin opposite the entry side of the printed circuit board cannot contain a retaining board, as it would not fit through the printed circuit board. Therefore, on one side of the printed circuit board, the pin is of a constant width, sometimes as narrow as 0.50 mm. The housings which enclose these pins generally have passageways which are interference fit with the pins.

One of the drawbacks to this approach is that, as the housings are inserted over the pin field, the housings interfere with the pin field, and leave some of the plastic on the pins themselves which could lead to an unstable contact, as the plastic is directly on the contact surfaces. Thus, as the mating contact receptacle could have plastic particles between the contact surfaces and the pin itself, an ineffective contact could be made. Secondly, as many housings are made from glass filled housings, the glass particles in the housing could actually skive through the gold plating on the contacts, again leading to an ineffective contact system.

SUMMARY OF THE INVENTION

An object of the invention then is to provide an electrical connector system, and preferably a pin field, where two headers can be attached back-to-back on a printed circuit board, where the installation of the second header, causes no instability to its associated contact.

The objects of the invention were accomplished by providing an electrical pin field comprising a printed circuit board having a plurality of pins extending between both sides thereof to position a pin contact portion on opposite sides of the board. The pin field has an insulating housing mounted on both sides of the board. The pin field is characterized in that at least one of the housings includes a locking plate medially positioned between the board and the housing, the locking plate having a plurality of throughholes for receiving the pins and at least one gripping arm extending towards the housing, adjacent to each throughhole. The gripping arm is interference fit with the passageway in the housing and positioned against the pin portion.

DETAILED DESCRIPTION OF THE PREFERRED EMBODIMENT

Figure 1:
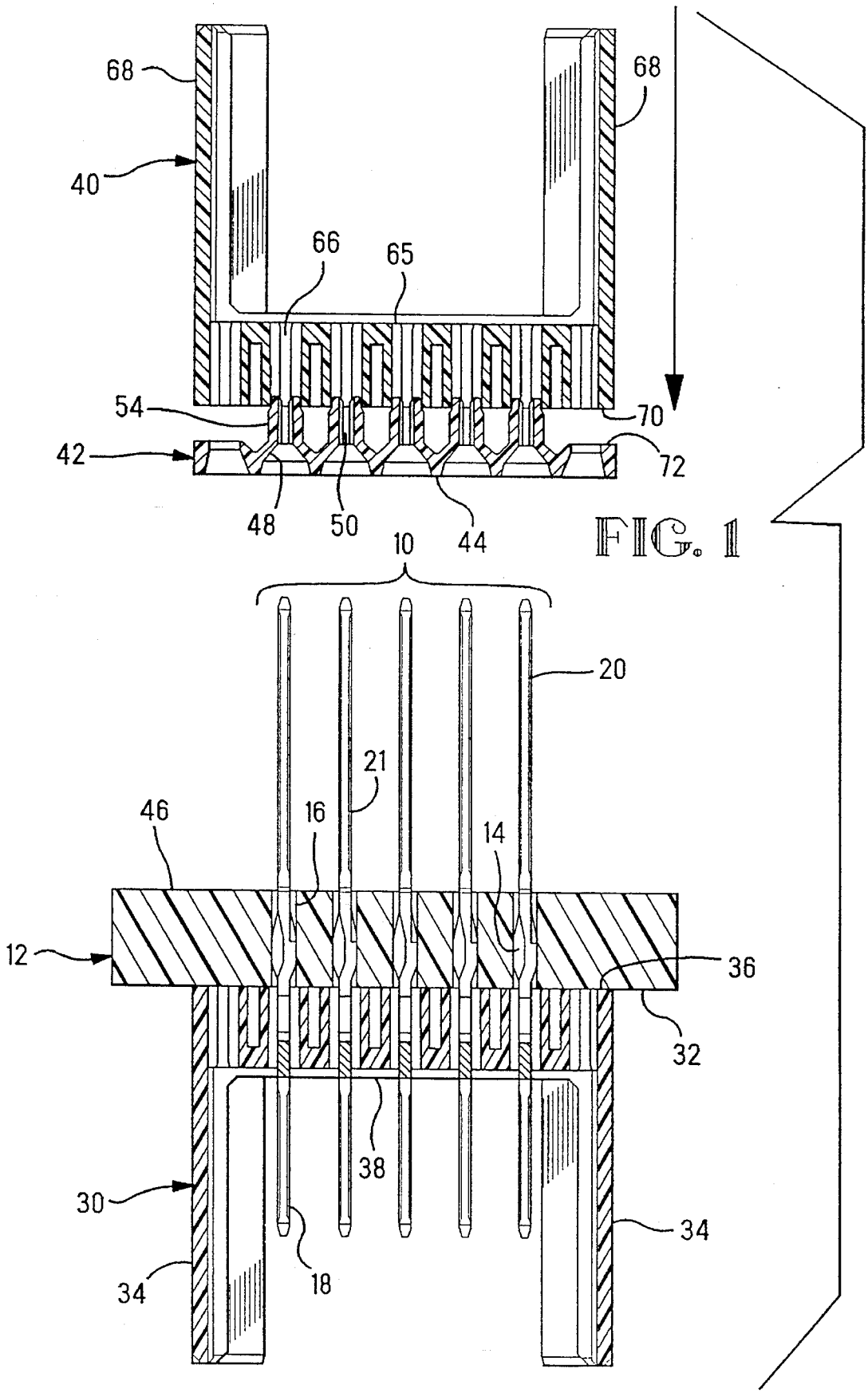
FIG. 1 is a cross-sectional view showing a first header mounted to the lower side of a printed circuit board with the spacer member and second header poised for receipt over the pin field.

With reference first to FIG. 1, an electrical pin field is shown generally by a plurality of pins 10 positioned on the printed circuit board 12, the pins being retained in position on the printed circuit board by compliant portions 14 on the pins inserted into through-holes 16 on the printed circuit board. The pins 10 generally include contact sections 18 on one side of the printed circuit board and contact sections 20 on the opposite side, the contact sections 18 and 20 being profiled for receiving complementary plug connectors in electrical engagement.

Figure 6:
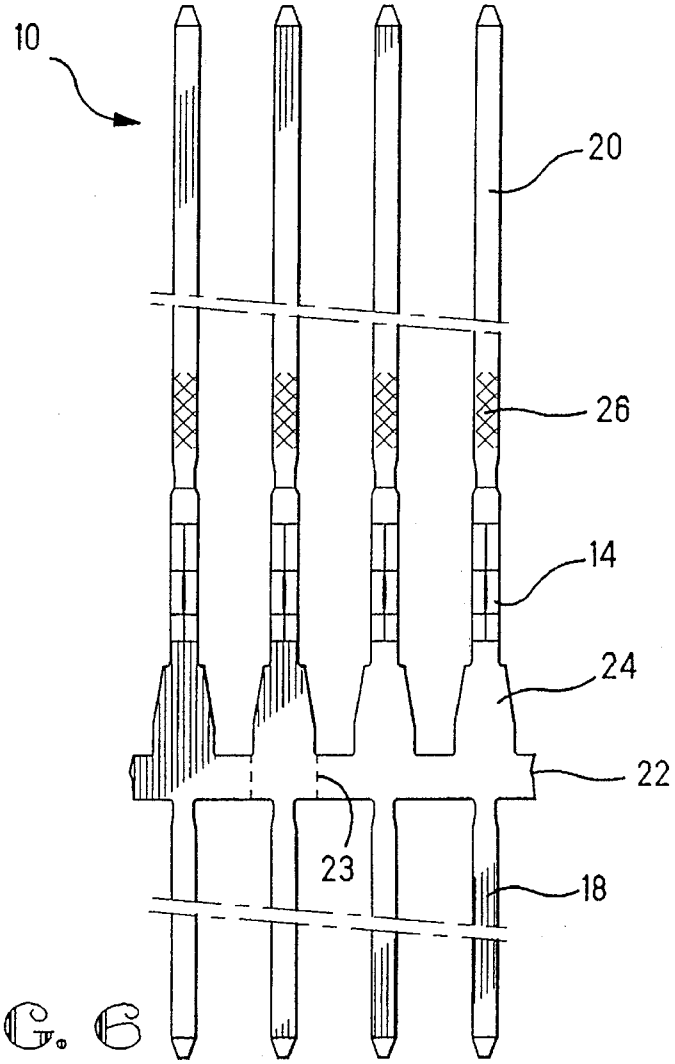
FIG. 6 is a plan view of a portion of the electrical pins used for the pin field.

With respect now to FIG. 6, the electrical pins 10 are shown as they are formed on a carrier strip such as 22 for reeling, or for assembly purposes with the electrical housings. The terminals 20 will be sheared from the carrier strip 22 at phantom lines 23 for end use. The compliant portions are shown generally at 14 with enlarged portions shown at 24 which will be used for retaining the pin terminals within their respective housings, as will be described in greater detail herein. The contact portions 20 are shown above the compliant section 14 whereas the compliant portions 18 are shown positioned below the compliant portions 14. The surfaces at 26 are roughened to provide a greater frictional surface as will be described in greater detail herein.

With reference again to FIG. 1, a housing member 30 made from an insulating material is positioned over the contact portions 18 of the pins 10 to form a header assembly on the lower side 32 of the printed circuit board 12. This header assembly could be similar to that shown in European Patent Application 0 422 785. This housing 30 generally comprises upstanding sidewalls 34 on either side thereof which provides an opening for a complementary plug connector which could either be shielded or unshielded. With reference again to FIG. 6, it should be noted that the enlarged sections 24 of the terminals 10 are positioned medially of the contact portions 18 and the compliant pin portions 14. The insulating housing 30 is profiled to receive the contact portions 18 from a rear side 36 of the housing 30.

Thus as mentioned above, the pin field comprising the plurality of pins 10 can either be positioned in the printed circuit board 12, and then later receive the housing member 30 thereover such that the housing member 30 is positioned with the mounting face 36 facing the surface 32 of the printed circuit board and then forced against the printed circuit board. Alternatively, the pins 10 could be forced in the housing member 30 and the header assembly comprising the housing 30 and the pins 10 could be placed against the lower side 32 of the printed circuit board 30. In either case, it should be appreciated that the enlarged portions 24 of the terminals 10 prevent removal of the housings over the terminals, the housing 30 being profiled to receive the enlarged section 24 therein.

In the preferred embodiment of the invention, the terminals 10 are profiled to be received in a printed circuit board throughhole having a 0.55 mm diameter. Therefore as the pins must pass through the printed circuit board, with the contact portion 20 leading, this prevents having an enlarged portion similar to 24 on the opposite side of the compliant pin portion 14 for retaining another housing thereto. Also as mentioned above, previous connectors have held the opposing housing to the contacts and to the printed circuit board by providing an interference fit between the contacts, for example at 20, with the throughholes in the housing such that the housing interferingly fits during the entire insertion of the connector housing over the pin field at 10.

Figure 2:
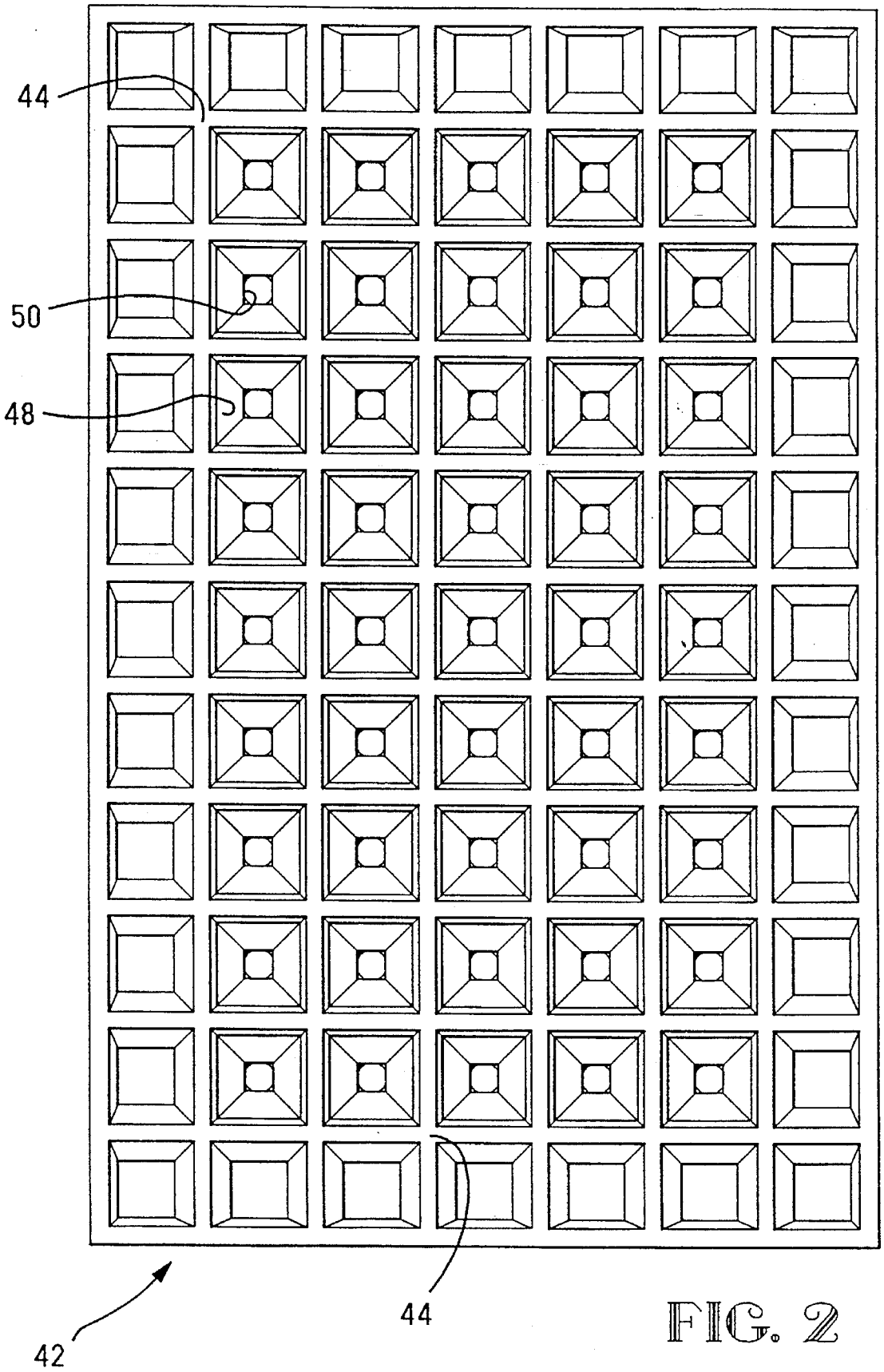
FIG. 2 is a top view of the spacer plate.
Figure 3:
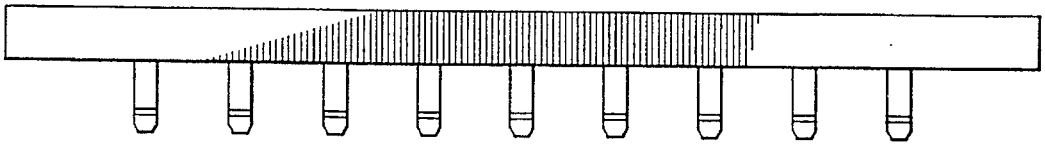
FIG. 3 is a side view of the spacer plate.
Figure 4:
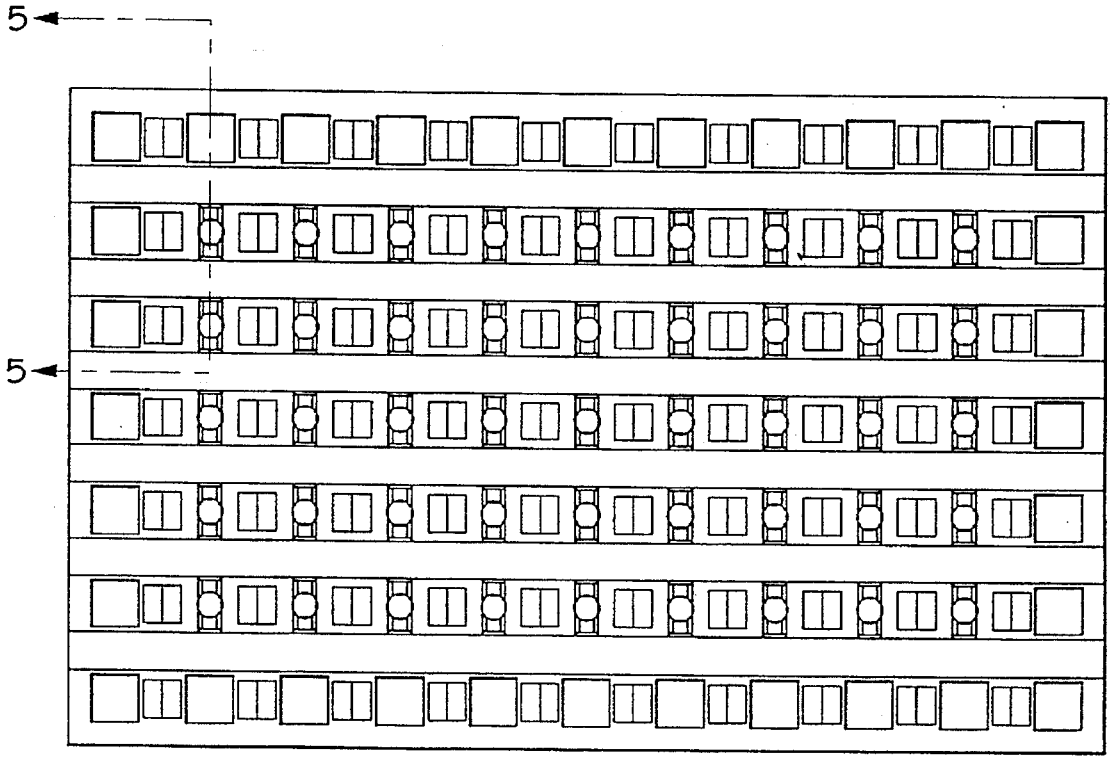
FIG. 4 is a lower plan view of the spacer plate.
Figure 5:
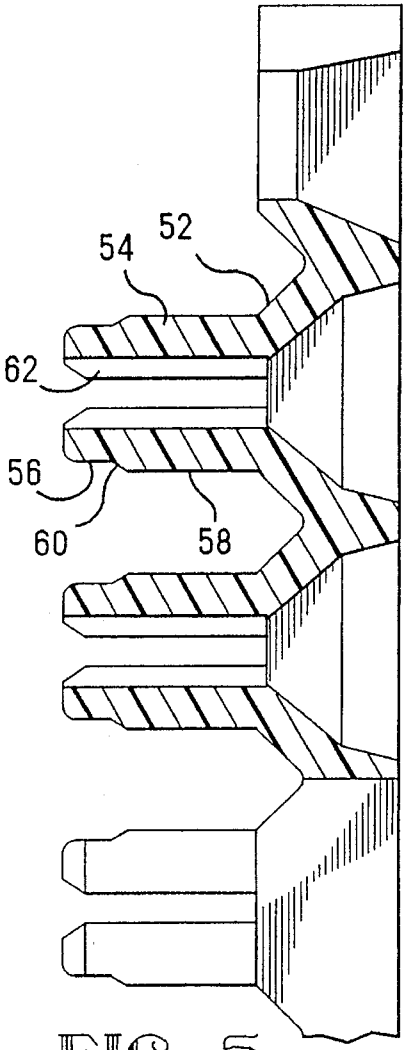
FIG. 5 is a cross-sectional view through lines 5—5 of FIG. 4.

Rather in the present embodiment, applicants have provided an improved housing having a locking spacer member 42. As shown best in FIG. 2, the spacer member 42 has a lower face at 44 which is profiled for receipt against an upper surface 46 of the printed circuit board 12. The locking spacer plate 42 includes a plurality of lead-in openings 48 for easy placement of the locking spacer member 42 over the pin field at 10. Movement of the plate 42 over the pin field, centers each of the pins 10 with a central throughhole 50 in the spacer plate 42. As shown best in FIGS. 3–5, the spacer plate 42 has an opposite surface 52 including locking arms 54 extending from opposite sides of the opening 50. As shown best in FIG. 5, the locking arms 54 include thin portions 56 adjacent to the distal end thereof and thickened portions 58 defined through a transition section 60. Also with reference to FIG. 5 and 9, the surface facing the pins 10 has a cylindrical surface 62 forming outer tip surfaces at 64.

Figure 9:
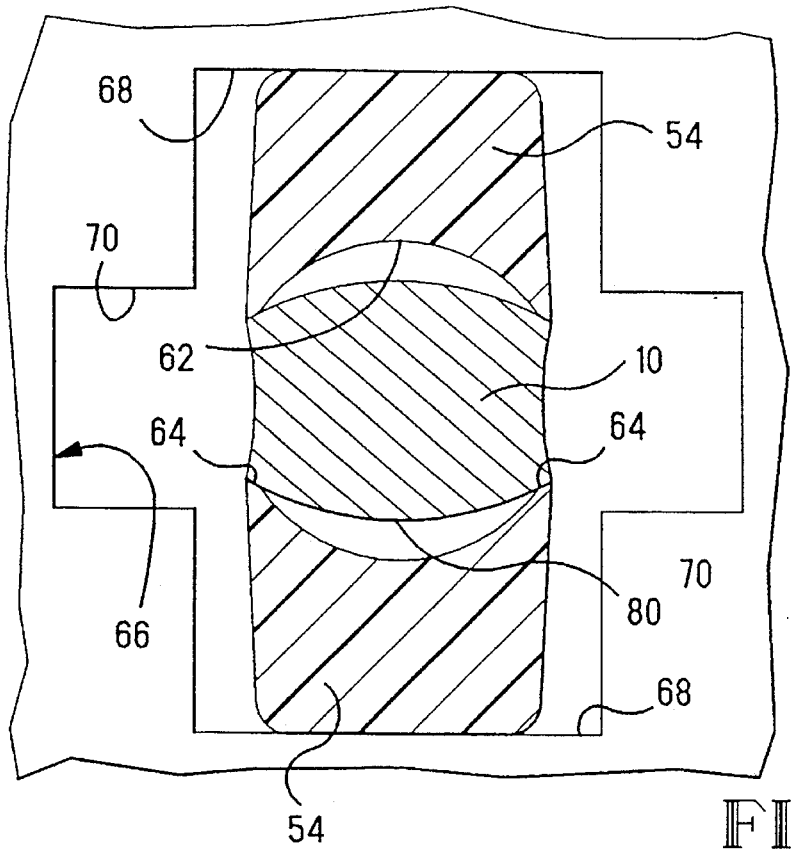
FIG. 9 is a cross-sectional view through lines 9—9 of FIG. 7.

With reference again to FIG. 1, the housing member 40 is similar in nature to the housing member 30, including a central section at 65 having a plurality of terminal passageways at 66 and sidewalls at 68 for receiving a complementary plug member. The housing member 40 further includes a lower mounting surface 70 which can be placed against a mounting surface 72 of the spacer member 42 when in the final position. As best shown in FIG. 9, the housing passageways 66 are cruciform in configuration including end portions 68 which receive the locking arms 54 and side portions 70.

Figure 7:
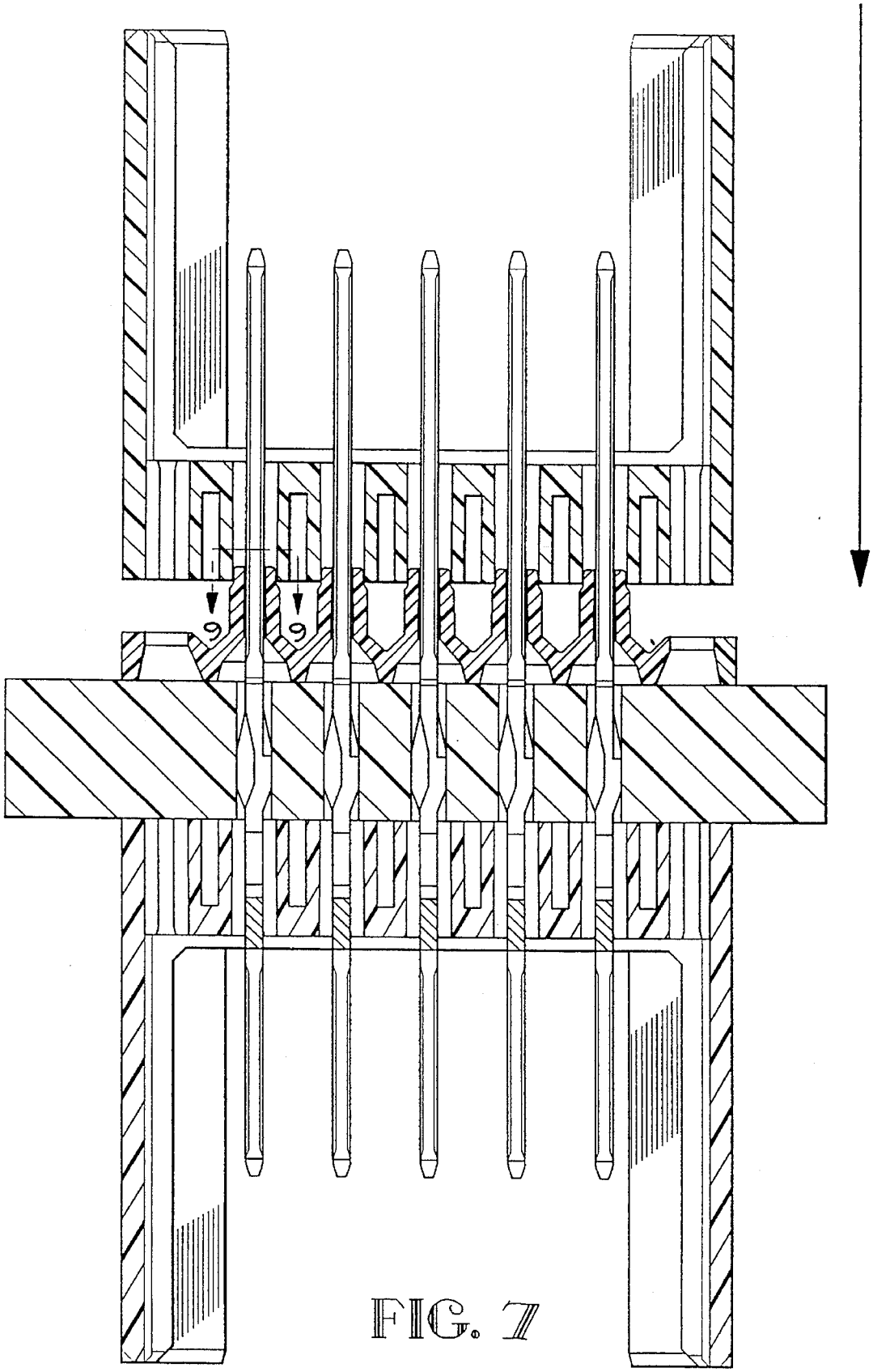
FIG. 7 is a view similar to that of FIG. 1 showing the initial reception over the header of the spacer plate.
Figure 8:
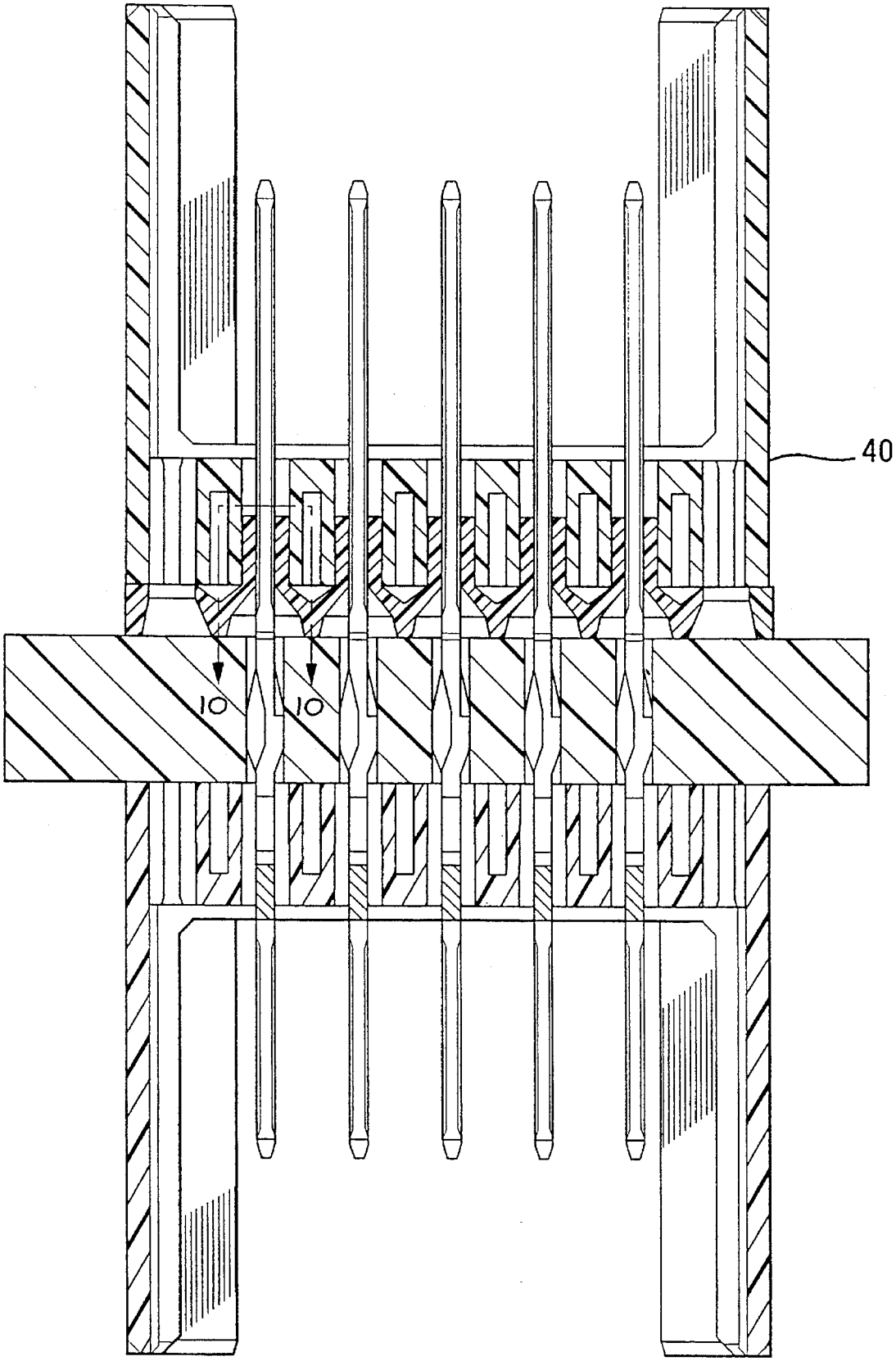
FIG. 8 is a view similar to that of FIG. 7 showing the fully assembled spacer plate and header on the pin field.

With the pin field 10 and the housing member 30 applied to the printed circuit board 12 as shown in FIG. 1 and as described above, the housing member 40 can now be applied to the printed circuit board 12 by way of the locking spacer 42. The spacer member 42 can be attached to the housing member 40 as shown in FIG. 1 and applied over the pin field 10 such that the lead in portion 48 are aligned with each of the pins at 10, and the spacer plate 42 can then be lowered until the surface 44 of the spacer member 42 abuts the surface 46 of the printed circuit board. It should be appreciated that when in the position shown in FIG. 7, that there is little resistance between the retaining arms 54 and the pins 10, as the narrowed portions 56 of the retaining arms 54 provide little interference with the pins 10. This is best shown in FIG. 9 where the outer tips 64 only contact the outer edges of the pin member 10. In the preferred embodiment of the invention, the pin is barrel shaped in cross-section, as shown in 10 to cooperate with the contact arms 54.

Figure 10:
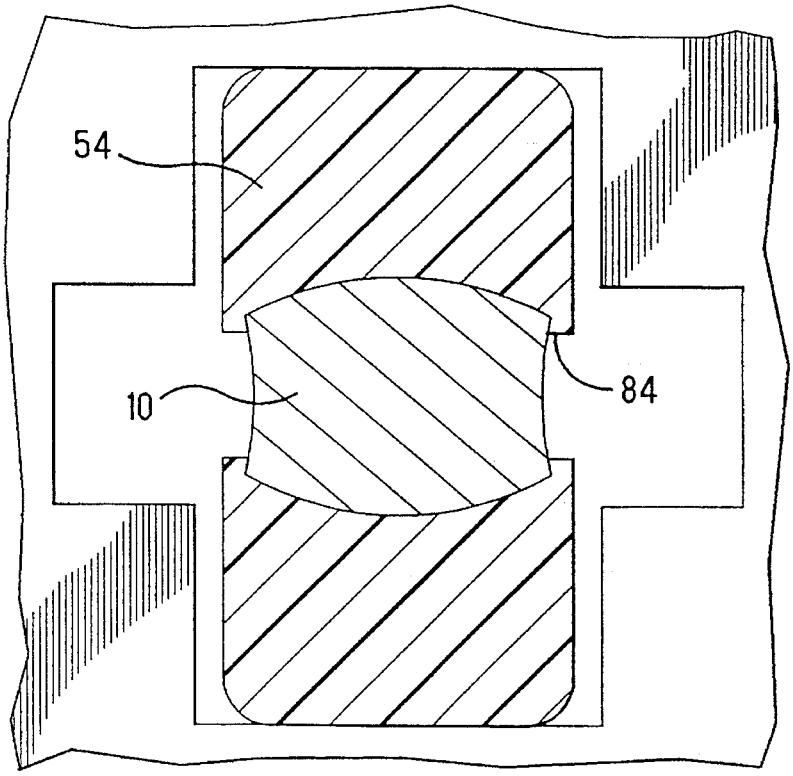
FIG. 10 is a cross-sectional view through lines 10—10 of FIG. 8.

Further movement of the housing member 40 against the spacer plate 42 causes interference between the contact arms 54 and the pin member 10 by way of the enlarged section 58 of the locking arms 54. This interference fit causes plastic material to flow around the edges of the pin 1 for example as shown at 84 in FIG. 10. In this manner, the locking arms 54 are in gripping position against the roughened portions 26, to thereby retain the housings to the printed circuit board.

Figure 11:
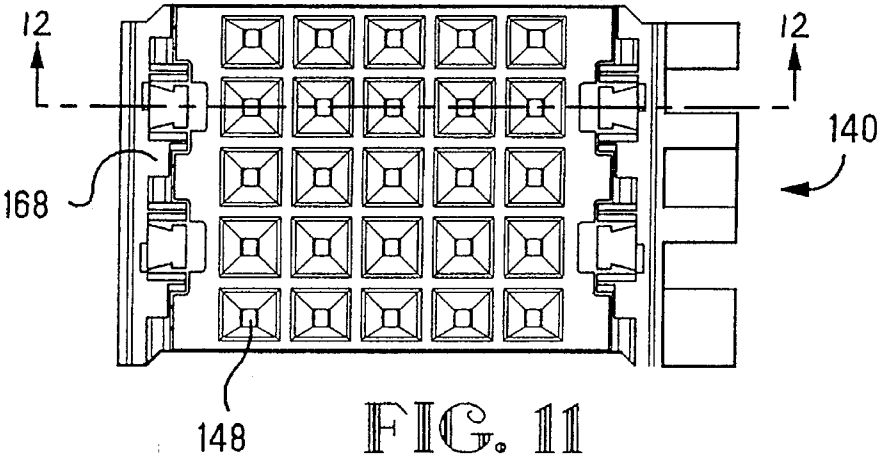
FIG. 11 shows an alternate embodiment of an upper header as shown in FIG. 1, which can be used with the lower header and pin field.
Figure 13:
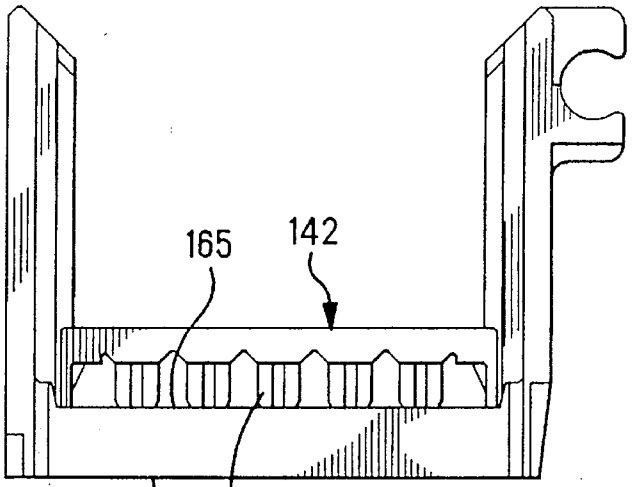
FIG. 13 is a side view of the header shown in FIG. 11.
Figure 12:
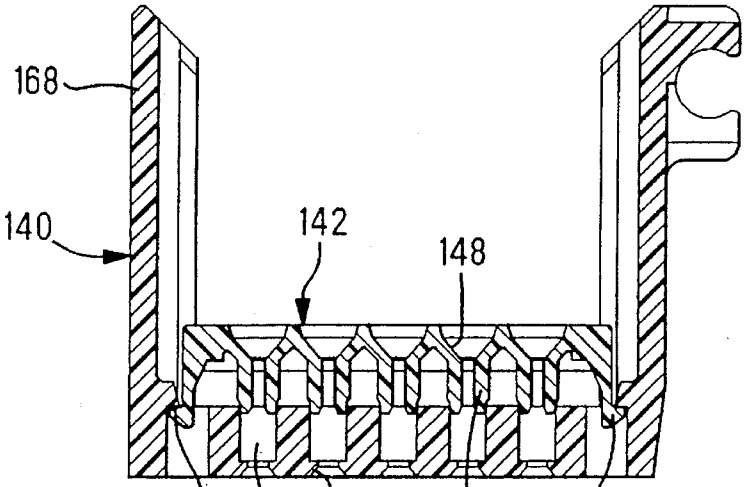
FIG. 12 is a cross-sectional view through lines 12—12 of FIG. 11.

With respect now to FIGS. 11–13, an alternate embodiment of upper header is shown as 140 having a locking plate 142, where the locking plate is positioned against the inside face 165 of the header 140. The locking plate 142 has latches 160 which are locked to corresponding shoulders 169 adjacent to the sidewalls 168. The locking plate 142 has locking arms 154 positioned within apertures 166 of the upper header 140 and operate in identical manner as locking arms 54 with respect to their corresponding apertures 66. The locking plate 142 is shown in its preassembled position in FIGS. 12 and 13, whereby the upper header 140 together with the locking plate 142 can be slidably received over the pin field 10 as shown in FIG. 1, to a position where the lower face 170 abuts the surface 46 of the printed circuit board 12.

The latch arms 160 together with the corresponding locking shoulder 169 retain the locking plate 142 to the upper header 140 during the insertion of the pins 20 between the locking arms 154. The locking plate 142 can thereafter be pushed downwardly such that the locking arms 154 are cammed inwardly as discussed above, and grip the individual pin sections 21. This embodiment has a self-locking geometry whereby if the header 140 is pulled upwardly, the locking arms 154 will be forced further inwardly into the apertures 166 forming a tighter gripping arrangement between the locking arms and the corresponding pins 21.

We claim:

1. An electrical pin field comprising a printed circuit board having a plurality of pins extending between both sides thereof, to position a pin contact portion on one side of the board, the pin field having a housing mounted on the one side of the board, the pin field being characterized in that a locking plate is positioned against the housing, the locking plate having a plurality of through holes for receiving the pins and at least one laterally movable gripping arm extending towards the housing adjacent to each throughhole, and being interference fit with a passageway in the housing and positioned against the pin portion.

2. The electrical pin field of claim 1, further characterized in that the housing is positioned medially of the locking plate and the board.

3. The electrical pin field of claim 1, further characterized in that the locking plate is medially positioned between the housing and the board.

4. The electrical pin field of any one of claims 1–3, further characterized in that a second housing is included on the other side of the board.

5. The electrical pin field of any one of claims 1–3, further characterized in that the locking plate is positioned on an inside surface of the housing, with the gripping arms extending into corresponding apertures.

6. The electrical pin field of any one of claims 1–3, further characterized in that the locking plate includes two opposed arms, opposing each passageway for insertion of said pins therethrough.

7. The electrical pin field of any one of claims 1–3, further characterized in that the arm has an arcuate surface along its length facing the pin surface.

8. The electrical pin field of any one of claims 1–3, further characterized in that the passageway includes a camming surface for urging said gripping arm into contact with said pin portions.

9. The electrical pin field of claim 1 or claim 2, further characterized in that the locking plate is latchable to the housing in a preassembled position, whereby the housing and the locking plate are joined together prior to engagement of the contact pins.

10. The electrical pin field of claim 9, further characterized in that the locking plate includes latches and the housing includes corresponding shoulders, the latches being latchable to the shoulders to retain the locking plate with the housing.

11. The electrical pin field of claim 1 or claim 2, further characterized in that the holes include a camming surface of self-locking geometry, whereby the camming surface is adapted to tighten the engagement finger upon the pin upon exertion of force upon the housing that would tend to separate the housing from the board.

12. An electrical pin field comprising a printed circuit board having a plurality of pins extending from one side thereof, to position a complementary connector relative to the pin field, housing is mounted on the one side of the board, the housing including a locking plate positioned against the housing and having a plurality of through holes for receiving at least some of the pins and at least one gripping arm extending towards the housing adjacent to each through hole, the arm being displaceable into an interference fit with the pin, thereby retaining the housing with the pins.

13. The electrical pin field of claim 12, wherein the housing includes a plurality of apertures surrounding at least some of the pins and formed in a central section of the housing and the corresponding gripping arm is received within the corresponding aperture.

14. The electrical pin field of claim 13, wherein the locking plate is positioned between the central portion and the board.

15. The electrical pin field of claim 13, wherein the central portion is positioned between the locking plate and the board.

16. The electrical pin field of any one of claims 13–15, wherein sidewalls extend from the central portion for receiving the mating connector.

17. The electrical pin field of claim 12, wherein the locking plate and the housing may be preassembled to a preassembled position where the assembly is mountable upon the pin field.

18. The electrical pin field of claim 12, wherein the arms include a lead section that interferes with the housing to laterally displace the arm into engagement with the pin.

19. An electrical connector fixable about a pin field upon a substrate for positioning a complementary connector relative the pin field, the pin field having a plurality of pins inserted into the substrate with a pin contact portion extending outward from at least one side thereof, the electrical connector comprising:

a housing positionable relative the pin contact portions for receiving the complementary connector;

a plurality of passageways through the housing for receiving the pin contact portion;

a locking plate positionable against the housing;

a plurality of through holes in the locking plate, corresponding to a passageway in the housing, for receiving the pin contact portion; and at least one displaceable gripping arm corresponding to at least some of the through holes and extending between the housing and the locking plate, the gripping arm being displaceable against the pin portion as the locking plate and the housing are positioned against each other.

20. The electrical connector of claim 19, wherein the gripping arm extends from the locking plate and is received in an interference fit within the passageway.

21. The electrical connector of claim 19 or claim 20, wherein the housing is disposed medially of the substrate and the locking plate.

22. The electrical connector of claim 19 or claim 20, wherein the locking plate and the housing are joinable together into a preassembled position where the gripping arms are clear of the pin portion, thereby enabling the preassembled connector to fit over the pins without interference.

23. The electrical connector of claim 20, wherein the gripping arm includes a transition portion that interferes with a camming surface of the passageway, thereby displacing the arm against the pin.

24. The electrical connector of claim 20, wherein the locking plate includes a pair of opposed gripping arms, opposing each passageway.

25. The electrical connector of claim 24, wherein the opposed gripping arms include a curved surface facing the pins.

* * * * *